US007096998B1

(12) United States Patent
Edmunds

(10) Patent No.: US 7,096,998 B1
(45) Date of Patent: Aug. 29, 2006

(54) STAIRWAY LIFT

(76) Inventor: Todd M. Edmunds, 14704 Woodward, Overland Park, KS (US) 66223

( * ) Notice: Subject to any disclaimer, the term of this patent is extended or adjusted under 35 U.S.C. 154(b) by 0 days.

(21) Appl. No.: 10/983,997

(22) Filed: Nov. 8, 2004

Related U.S. Application Data

(63) Continuation of application No. 10/625,932, filed on Jul. 24, 2003, now abandoned.

(51) Int. Cl.
*B66B 9/08* (2006.01)

(52) U.S. Cl. ..... 187/200; 182/141; 182/69.6; 414/921

(58) Field of Classification Search ..... 187/200, 187/239, 253, 272, 336–339, 226, 269, 414, 187/787, 921; 414/540, 467, 345, 592, 498, 414/630–660; 182/69.6, 149
See application file for complete search history.

(56) References Cited

U.S. PATENT DOCUMENTS 3,016,973 A * 1/1962 Williamson ..... 182/14
3,910,264 A * 10/1975 Mahieu ..... 182/69.4
4,457,402 A * 7/1984 Del Vecchio et al. ..... 187/200
5,154,569 A * 10/1992 Eryou et al. ..... 414/495
5,224,723 A * 7/1993 Hatas ..... 280/166
5,234,078 A * 8/1993 Smith ..... 187/200
5,322,408 A * 6/1994 Wooden ..... 414/495
5,499,694 A * 3/1996 Dorn ..... 187/200
5,632,357 A 5/1997 Matre
5,937,971 A * 8/1999 Storm ..... 187/200
6,050,366 A 4/2000 Lyons
6,071,064 A * 6/2000 Hackett ..... 414/545
6,182,798 B1 * 2/2001 Brady et al. ..... 187/282
6,601,677 B1 * 8/2003 Storm ..... 187/200

* cited by examiner

*Primary Examiner*—Kathy Matecki
*Assistant Examiner*—Stefan Kruer
(74) *Attorney, Agent, or Firm*—Hovey Williams LLP

(57) ABSTRACT

A combination elevator and stairway may be installed beneath a set of stairs and includes a lift mechanism which raises and lowers a platform or enclosed car and a pivoting stairway. The lift may be hydraulically or electrically actuated and may include a telescoping lift mechanism or scissor mechanism.

26 Claims, 10 Drawing Sheets

STAIRWAY LIFT

RELATED APPLICATION

This application is a continuation of U.S. patent application Ser. No. 10/625,932, filed Jul. 24, 2003 now abandoned.

BACKGROUND OF THE INVENTION

The present invention generally relates to platform elevators and, in particular, to a combination platform elevator and stairway which is selectively operable as a conventional stairway, or as a platform elevator to transport wheelchairs, passengers or freight from one level to another.

Persons with limited mobility such as the elderly or those constrained to use wheelchairs find access to areas of a house reachable using stairs such as the second floor or basement, difficult if not virtually impossible to reach unassisted. Various lift mechanisms such as a chair lift along the side of the stairs, or mechanisms which reconfigure the stairs into a flat lift are known in the art. Space limitations often make these systems unsuitable for use in a house. Additionally, many of these systems are cost prohibitive for a home owner.

SUMMARY OF THE INVENTION

The present invention provides an elevator for a wheelchair, passengers or other material operable between a first and second floor. The present invention includes a telescoping lift mechanism that may be located underneath a set of stairs, a power unit for the lift mechanism, a platform or enclosed car attached to the lift mechanism, a pivot for the stairs and a link arm from the lift mechanism to the pivoting stairs to move the stairs out of the way as the lift ascends.

DETAILED DESCRIPTION

Figure 1:
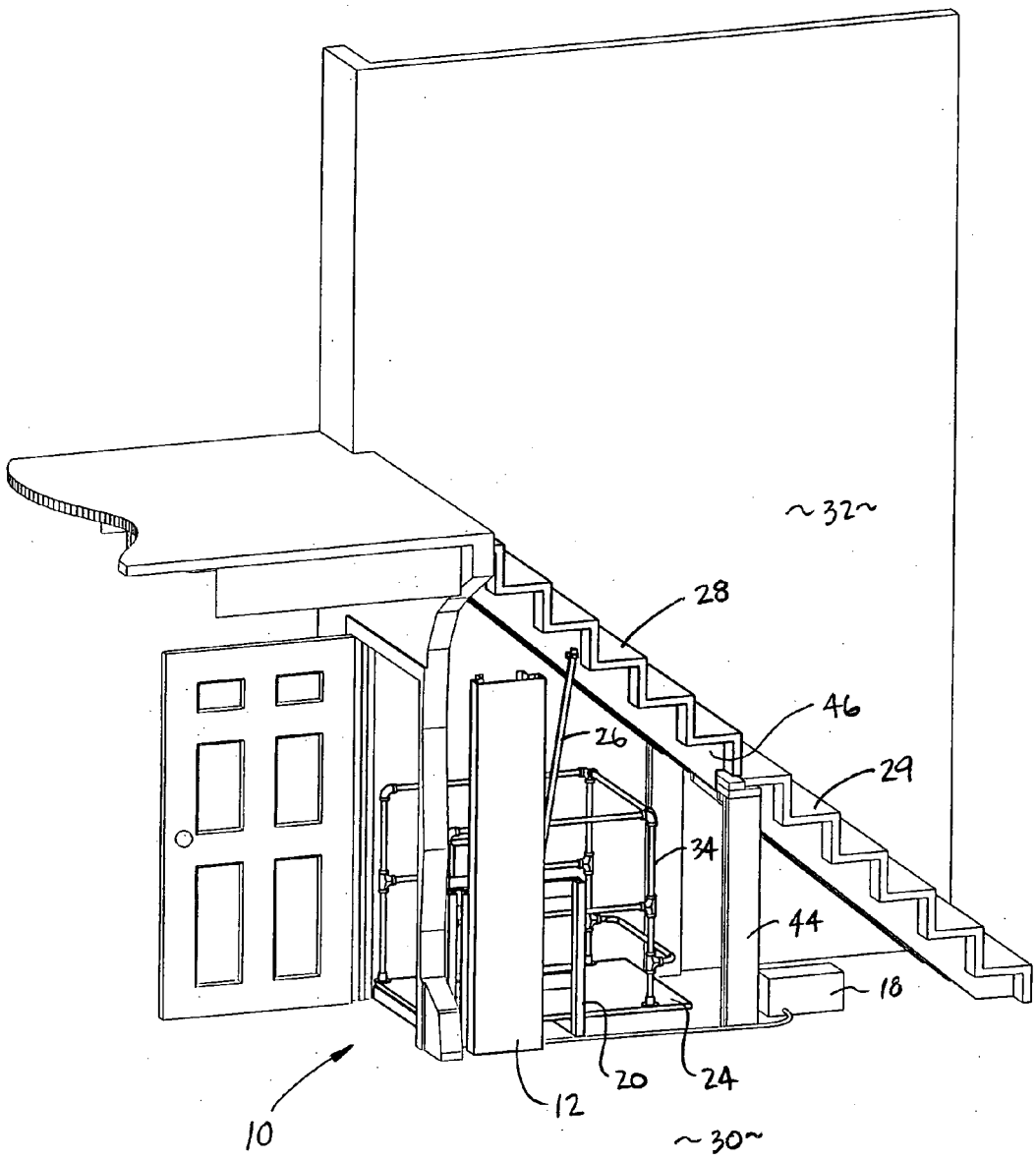
FIG. 1 is a perspective view of the stairway lift showing the lift in a lowered position stairs in the closed position.
Figure 2:
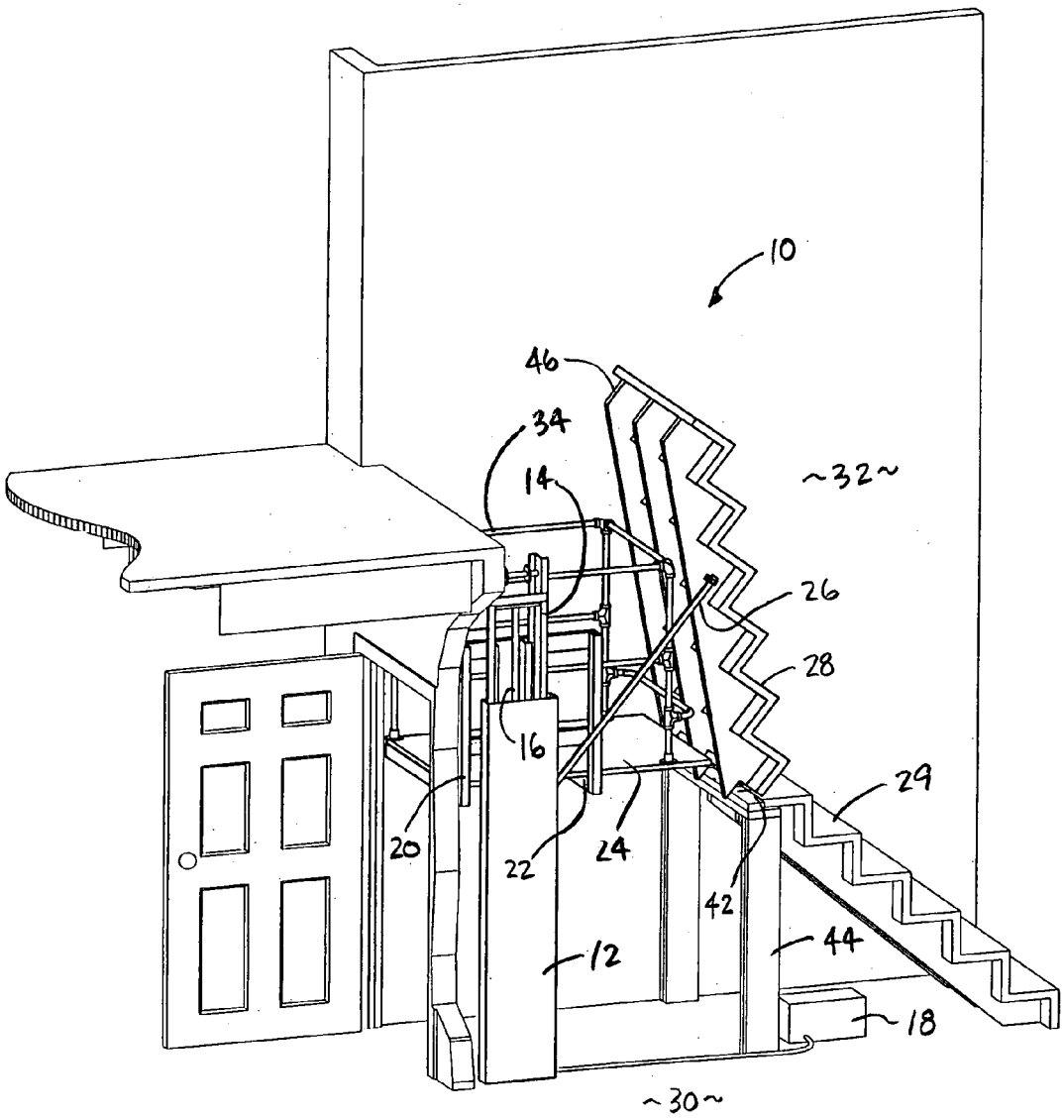
FIG. 2 is a perspective view of the stairway lift of FIG. 1 showing the lift in an intermediate position and the stairs in an open position.

Referring to FIGS. 1–6 the stairway lift of the present invention is generally indicated by reference number 10. Stairway lift 10 includes a base lift member 12, a telescoping lift mechanism 14 with a lift cylinder 16, a power unit 18, a lift carriage 20 secured to a support frame 22, a platform 24, a link arm 26 and a set of pivoting stairs 28 of staircase 29.

Telescoping lift mechanism 14 may be hydraulically actuated such as is used in man-lifts or aerial lift platforms and is anchored to the floor 30 and walls 32 underneath staircase 29. Other lift mechanisms may be used such as an electric motor actuated power screw or a scissor jack mechanism to raise platform 24, for example. Platform 24 includes guard rails 34 to safely enclose the platform.

A control panel 36 is mounted to the side of guard rail 34 along one of the sides of platform 24. The control panel 36 includes up 38 and down 40 control switches to selectively actuate the power unit 18 and raise or lower platform 24. Control switches 38 and 40 may be latched when pressed and reset when the selected level is reached. Wall mounted control switches (not shown) may also be used to "call" the stairway lift 10 in a manner similar to calling an elevator car.

Figure 3:
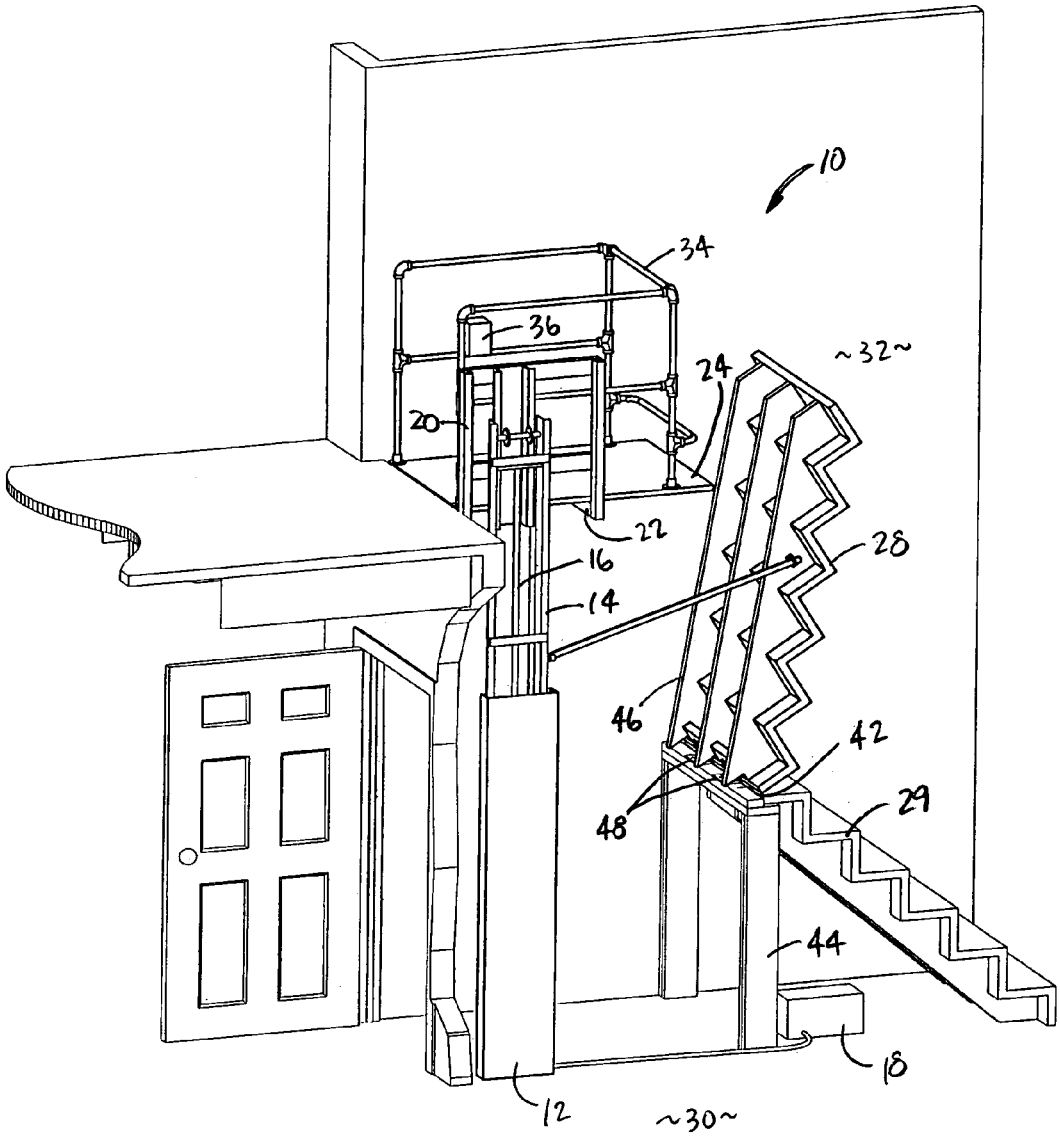
FIG. 3 is a perspective view of the stairway lift of FIG. 1 showing the lift in a raised position and the stairs fully open.
Figure 4:
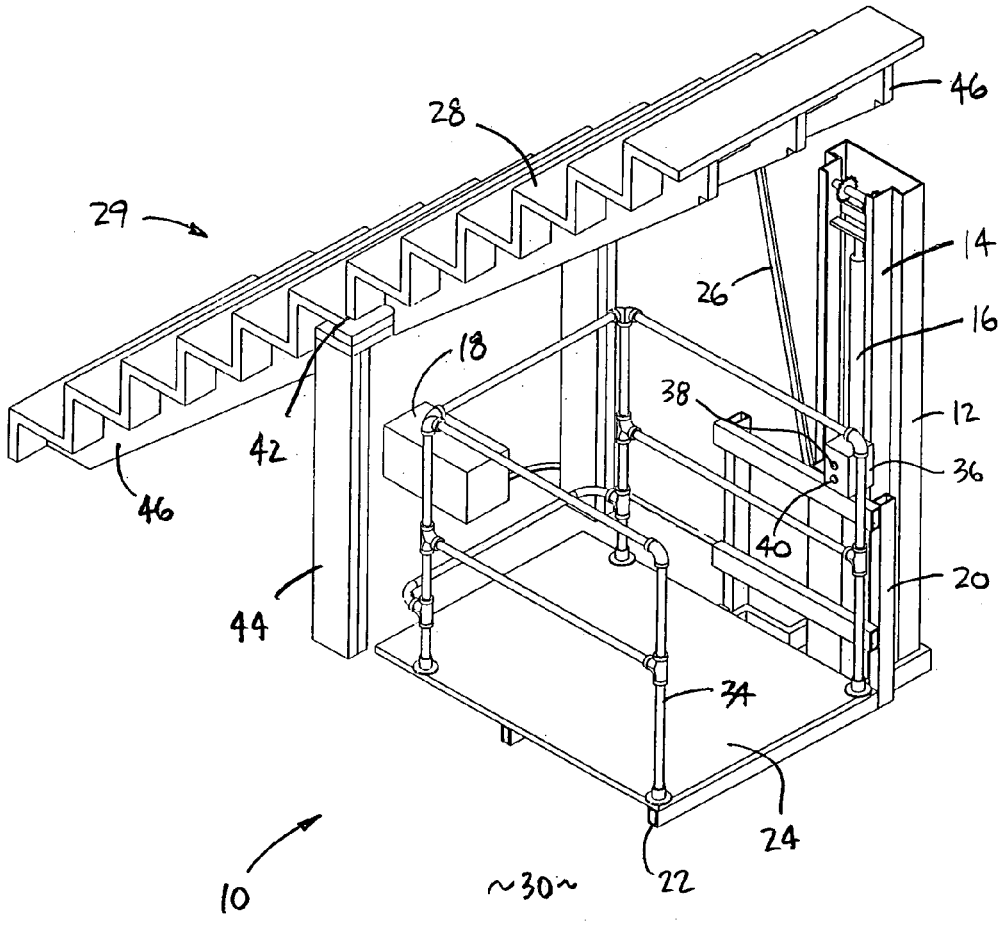
FIG. 4 is an alternate perspective view of the stairway lift of FIG. 1.
Figure 5:
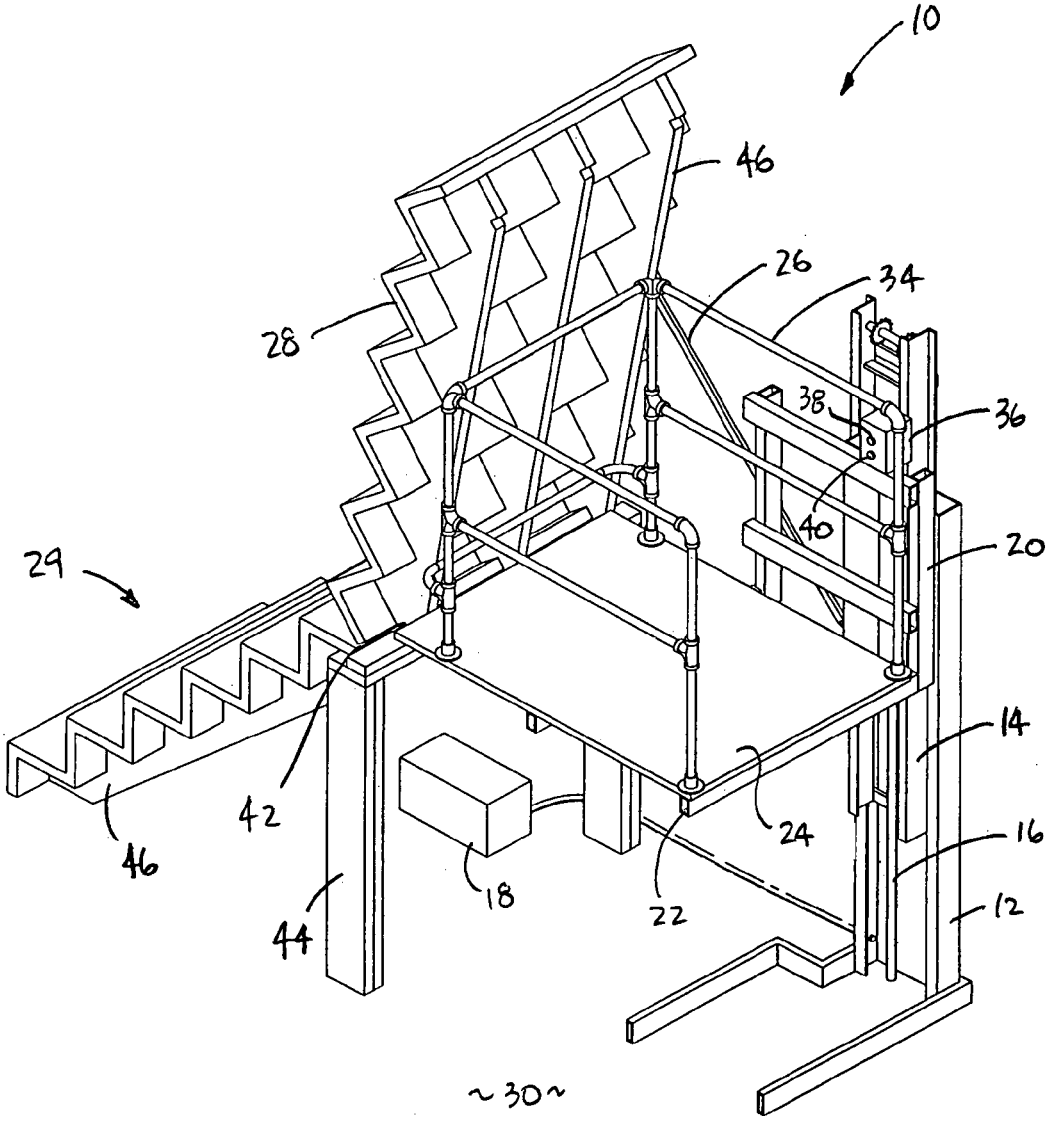
FIG. 5 is an alternate perspective view of the stairway lift of FIG. 2.
Figure 6:
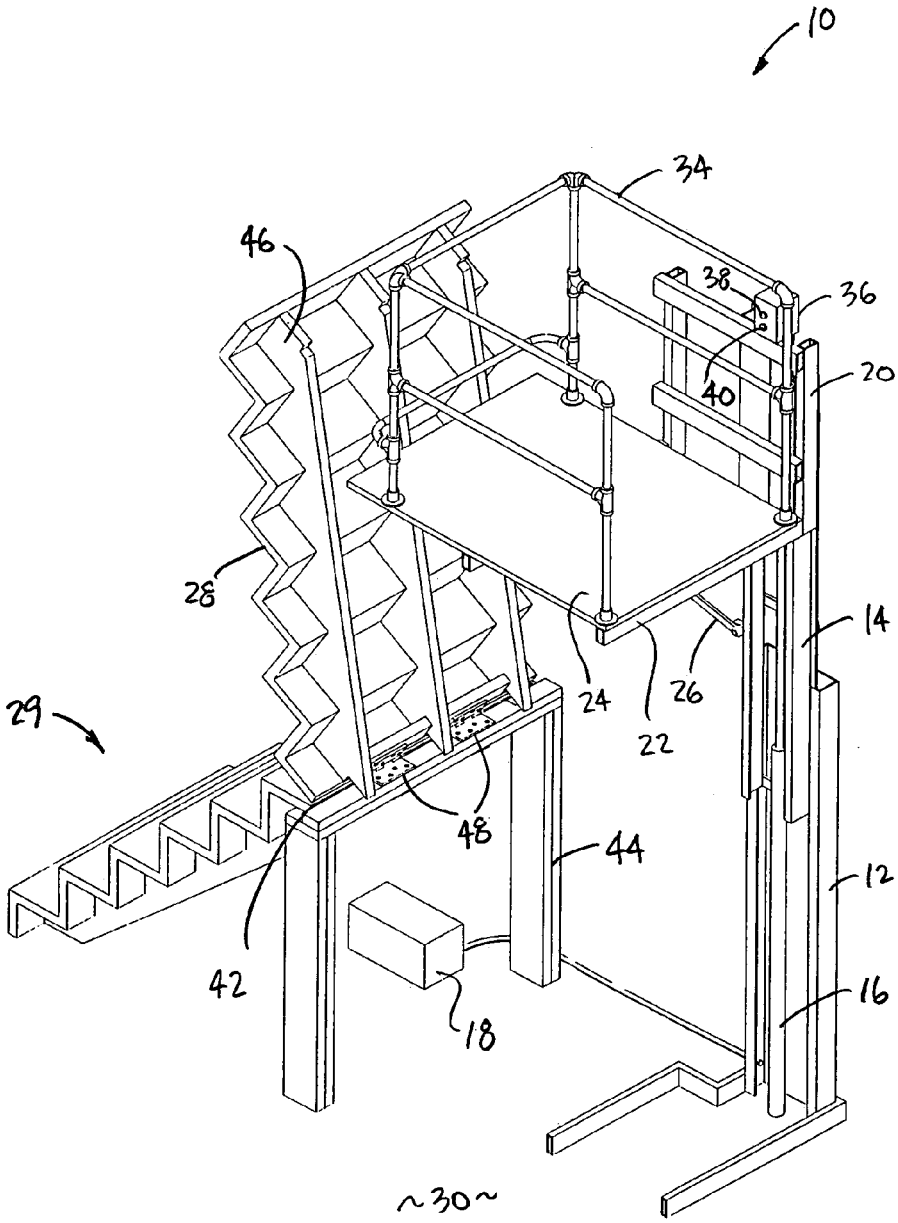
FIG. 6 is an alternate perspective view of the stairway lift of FIG. 3.

To raise the platform 24, a rider may push the up control button 38, which activates the power control unit 18. In response, the power control unit 18 activates an internal hydraulic pump (not shown), which applies hydraulic pressure to the hydraulic lift cylinder 16 to extend the telescoping lift mechanism 14 and thereby raise the platform 24. When the platform reaches the second floor (FIGS. 3 and 6), a limit switch (not shown) deactivates the hydraulic pump and closes a control valve (not shown) to maintain the hydraulic pressure in the lift cylinder 16, which remains in the extended position (FIGS. 3 and 6). A wall mounted control switch on the second floor (not shown) may also be used to actuate the power control unit 18 to raise the platform 24 from the first floor to the second floor.

To lower the platform 24, a rider may press the down control button 40, which signals the power control unit 18 to open the control valve (not shown) to allow the hydraulic fluid to flow from the lift cylinder 16 and thus lower the platform 24. Hydraulic cylinder 16 may also be positively driven in each direction instead of being passively lowered. A wall mounted control switch on the first floor (not shown) may also be used to actuate the power control unit 18 to lower the platform 24 from the second floor to the first floor.

Figure 9:
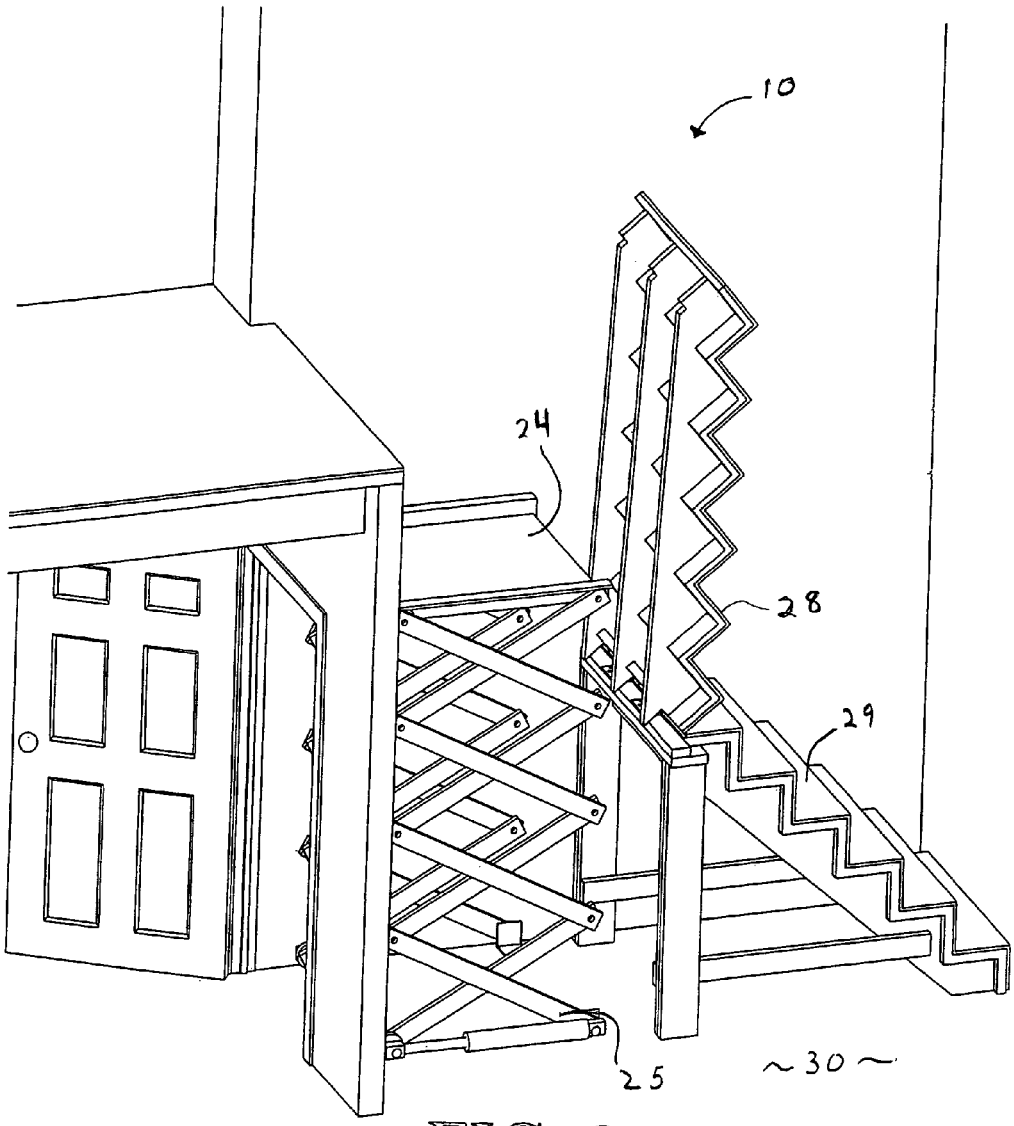
FIG. 9 is a perspective view of a stairway lift employing a scissor lift mechanism.

For the stairway elevator to ascend from the lower floor to the upper floor, the hydraulic power unit 18 provides hydraulic pressure to lift cylinder 16 which is coupled to the telescoping lift mechanism 14. The lift cylinder 16 may be driven in only one direction to raise the stairway elevator 10 and then passively retract under the weight of the platform 24 when a control valve (not shown) is opened to allow hydraulic fluid to escape from the cylinder 16. Cylinder 16 may include two driven ports to actuate the cylinder 16 in each direction under control of the power control unit 18 to raise and lower the platform 24. Other mechanisms may be used to raise and lower the platform 24 such as a motor driven power screw or a scissor mechanism 25 (see, FIG. 9).

As the telescoping lift mechanism 24 moves from a retracted position (FIG. 1) to an extended position (FIGS. 2 and 3), the link arm 26, which is pivotally secured at one end to the lift mechanism 24 and at the other end to the pivoting stairs 28, pushes the pivoting stairs 28 out of the way of the rising platform 24. The pivoting stairs 28 pivot about a hinged joint 42 between pivoting stairs 28 and a stairway pivot support frame 44. When the platform 24 is in the raised position (FIG. 3), pivoting stairway 28 is in a nearly vertical position to provide full clearance for the platform 24.

On preexisting stairs at a midpoint, the risers 46 are cut to separate the fixed stairs from the pivoting stairs 28. The risers are also cut at the top of the stairs where they join to the second floor. Hinges 48 are secured between the lower end of the pivoting stairs 28 and the stairway pivot support frame 44, which supports the upper end of the fixed stairs and the pivoting end of the pivoting stairs 28. The risers 46 are notched at the free end of the pivoting stairs 28 opposite the hinges 48 to rest on a support or stop secured to the second floor (not shown).

On a new installation, the fixed stairs may be constructed separately from the pivoting stairs and elevator.

The stairway elevator 10 may also be installed in stairways with a 90 degree or 180 degree turn and landing. The upper portion of these stairways may pivot with the lift mechanism installed in the space under the stairs and pivot at the landing.

When the pivoting stairway 28 is in the closed position (FIG. 1), the stairs appear normal with no noticeable break or pivot line. The pivot line may be completely concealed by a carpet or other floor covering appropriate for a stairway.

Safety features may also be included in the installation to protect users. For example, the control panel and the wall mounted control panels (not shown) may include locking switches or a key pad with a combination code to activate the system. The control switches may be momentary switches which require that the user hold the button in to operate the elevator. If a button is released while the elevator 10 is operating, the elevator 10 may stop until a button is pressed again.

A manual or automatically gate may be included to block the upper opening when the pivoting stairs 28 are not in the lowered position. A limit switch may be included to control activation of the automatic gate or to cut power to the power unit if a gate or door is opened during operation. The door to the lower access may also be normally locked to limit access the stairway lift 10 during operation.

Figure 10:
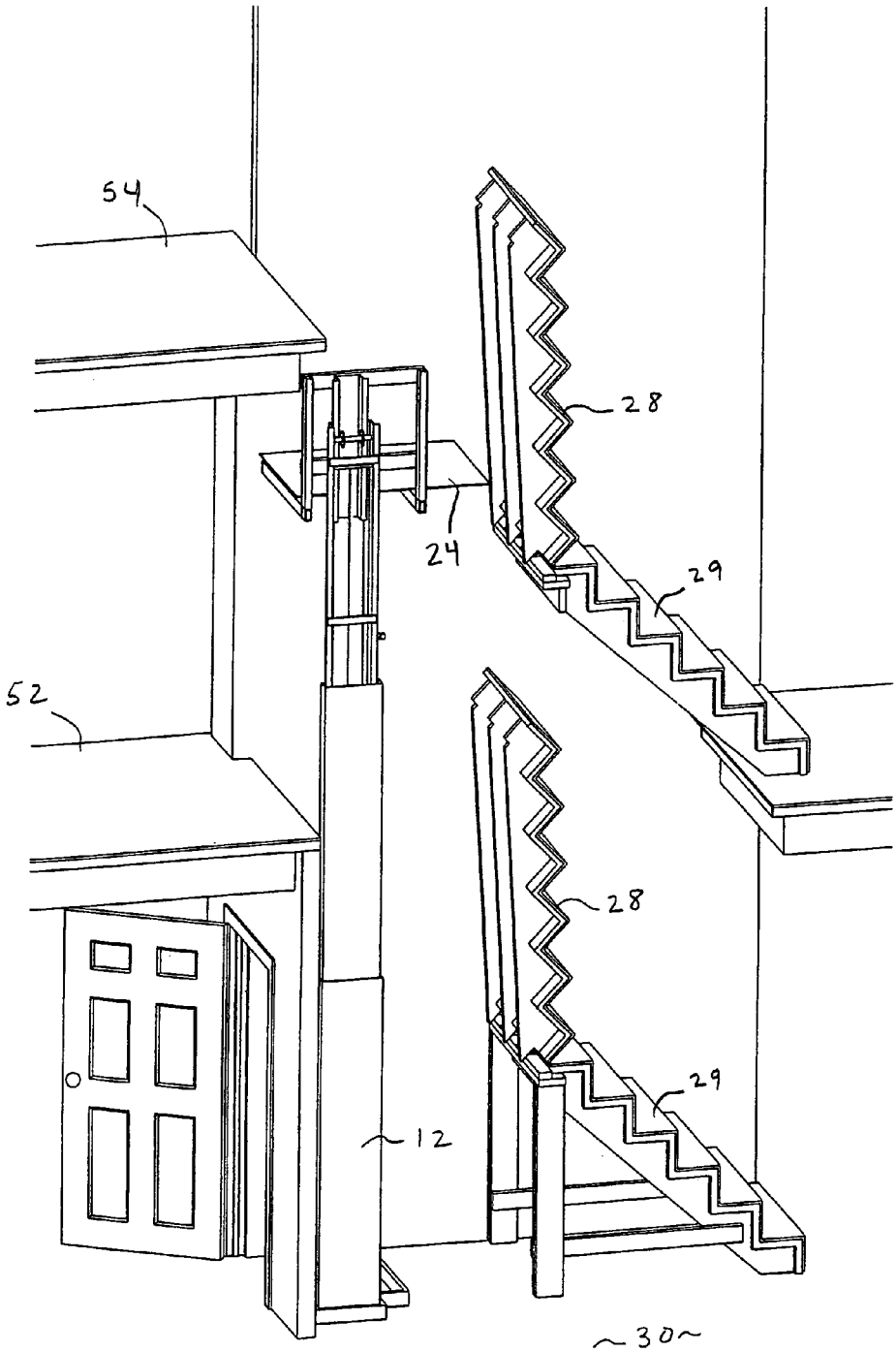
FIG. 10 is a perspective view of a stairway lift extending between a plurality of floors.

The stairway elevator 10 may extend to two or more floors 52, 54, as shown in FIG. 10, using additional link arms (not shown) to move the other sets of pivoting stairs out of the way. A separate pivoting mechanism may be used to move the stairs without a direct link to the lift mechanism.

Figure 7:
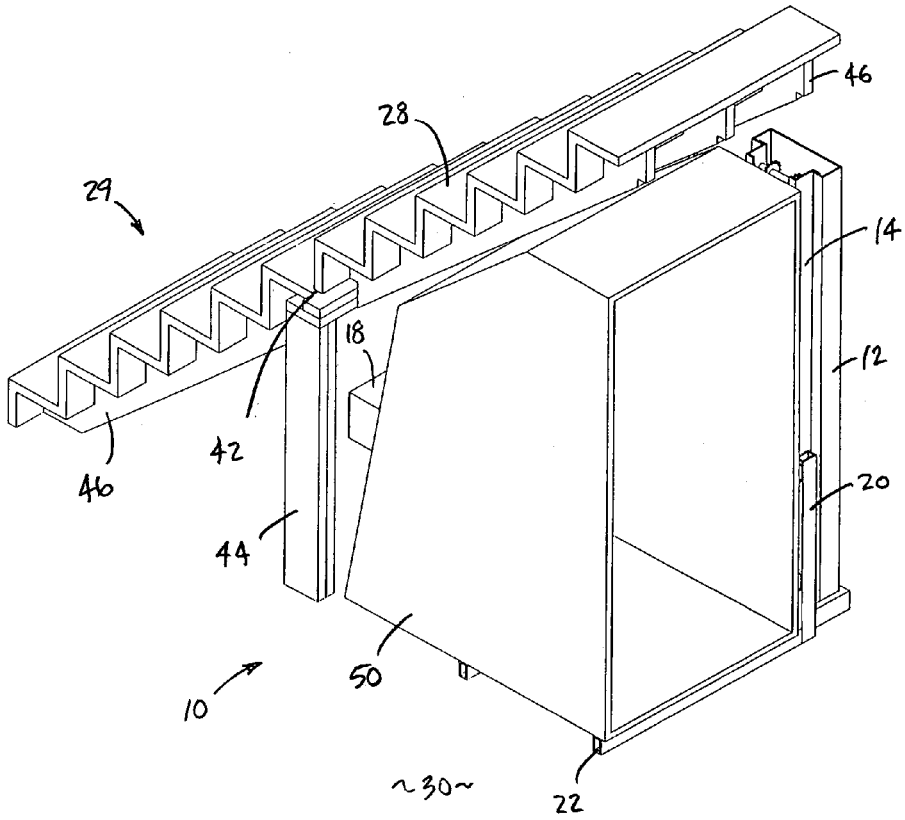
FIG. 7 is a perspective view of the stairway lift of FIG. 1 with an enclosed car.
Figure 8:
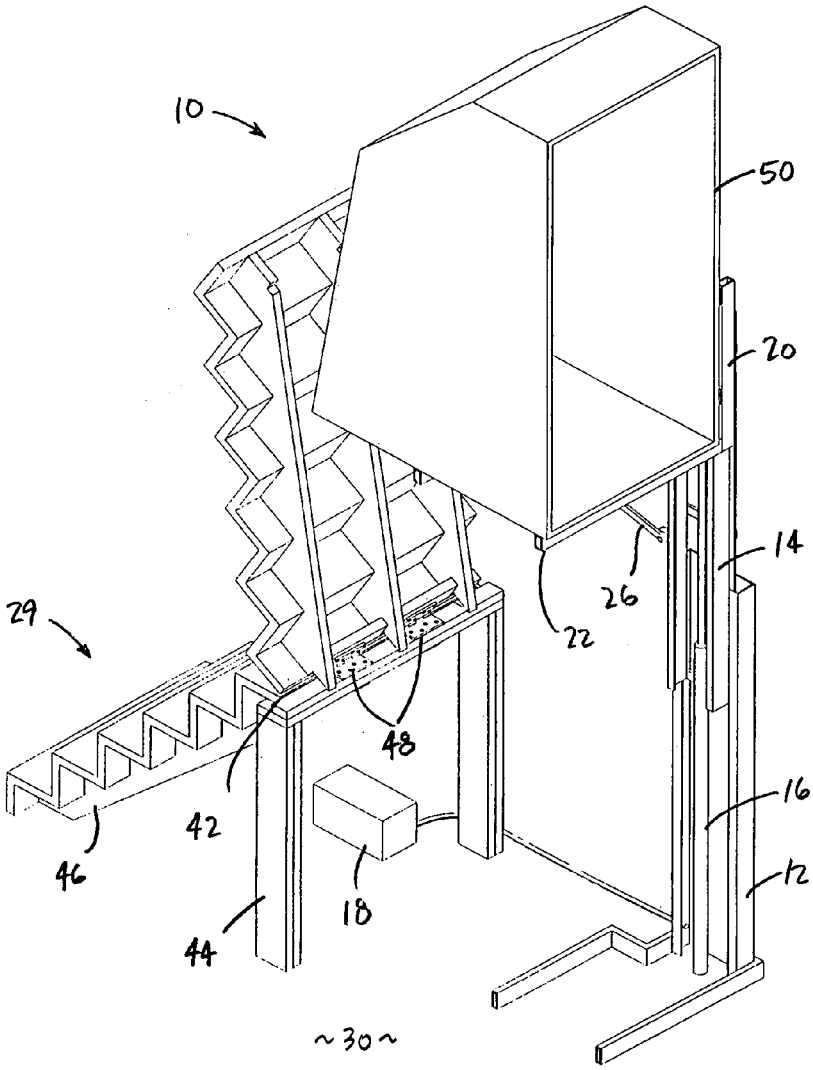
FIG. 8 is a perspective view of the stairway lift of FIG. 3 with an enclosed car.

Referring to FIGS. 7 and 8, the stairway elevator 10 may include an enclosed car 50 to transport passengers or materials. The car 50 may be shaped to fit beneath the pivoting stairs 28 and protect the passenger from any moving parts of the stairway elevator 10.

The invention claimed is:

1. In combination with a stairway, an elevator operable between a lower floor and an upper floor, said elevator comprising:

an elevator mechanism having a base, a lift cylinder, a telescoping member, a lift frame secured to said telescoping member, a platform, and a power unit, said lift cylinder having a first end secured to said base and a second end secured to said telescoping member, said second end extendable between a retracted position and an extended position;

said lift cylinder coupled to said power unit, said telescoping member slidably secured to said base and movable between a nested and extended position, a controller coupled to said power unit, said power unit responsive to control signals from said controller to selectively actuate said lift cylinder to move said second end of the lift cylinder between said retracted and extended positions, whereby to move said telescoping member between said nested and extended positions to raise and lower said platform, a stairway including a fixed section and a movable section, said movable section being pivotable between a closed position and an open position, said fixed section remaining fixed during shifting of said movable section, and a link arm having a first end coupled to said telescoping member and a second end coupled to said movable section, whereby said link arm pivots said movable section from said closed position when said telescoping member is in said nested position to said opened position when said telescoping member is in said extended position, said elevator mechanism being located underneath said stairway when said movable section is in said closed position.

2. The combination as claimed in claim 1 wherein said lift cylinder is hydraulically actuated.

3. The combination as claimed in claim 1 further comprising an enclosed car secured to said platform.

4. In combination with a stairway, an elevator operable between a lower floor and an upper floor, said elevator comprising:

a lift mechanism secured to said lower floor and extendable between a first position and a second position, a platform secured to said lift mechanism, a controller coupled to said lift mechanism, a stairway including a fixed section and a movable section, said movable section being pivotable between a closed position and an open position, said fixed section remaining fixed during shifting of said movable section, said lift mechanism responsive to control signals from said controller to selectively actuate said lift mechanism to move between said first and second position, and a pivot mechanism coupled to said movable section and responsive to movement of said lift mechanism between said first and second positions, whereby said pivot mechanism pivots said movable section from said closed position when said lift mechanism is in said first position to said open position when said lift mechanism is in said second position, said platform being located underneath said stairway when the movable section is in said closed position.

5. The combination as claimed in claim 4 wherein said lift mechanism includes a telescoping member slidably secured to said lift mechanism and movable between a nested position and an extended position.

6. The combination as claimed in claim 5 wherein said telescoping member is hydraulically actuated.

7. The combination as claimed in claim 5 wherein said telescoping member is electrically actuated.

8. The combination as claimed in claim 4 wherein said lift mechanism includes a scissor lift.

9. The combination as claimed in claim 4 wherein said pivot mechanism includes a link arm having a first end coupled to said lift mechanism and a second end coupled to said movable section whereby said link arm pivots said movable section from said closed position when said lift mechanism is in a first position to said open position when said lift mechanism is in said second position.

10. The combination as claimed in claim 4 wherein said stairway includes a hinge secured to a support structure wherein said movable section pivots about said hinge.

11. The combination as claimed in claim 10 wherein said hinge is hydraulically actuated in response to control signals to pivot said movable section from said closed position when said lift mechanism is in said first position to said open position when said lift mechanism is in said second position.

12. The combination as claimed in claim 10 wherein said stairway includes a pivot mechanism responsive to said control signals to pivot said movable section from said closed position to said open position when said lift mechanism moves from said first position to said second position.

13. The combination as claimed in claim 4 wherein said lift mechanism extends to a plurality of upper floors.

14. The combination as claimed in claim 4 further comprising an enclosed car secured to said lift mechanism.

15. A stairway lift system operable between a lower floor and an upper floor comprising:

a lift mechanism moveable between a first position and a second position;

an elevator assembly secured to said lift mechanism; and a stairway including a fixed section and a movable section, said movable section being shiftable between a closed position and an open position in response to movement of said lift mechanism between said first and second positions, said fixed section remaining fixed during shifting of said movable section, said elevator assembly being located underneath said stairway when the movable section is in said closed position.

16. The system of claim 15, said system further comprising a controller coupled to said lift mechanism for controlling the movement of said lift mechanism between said first and second positions.

17. The system of claim 15, said elevator assembly comprising a platform.

18. The system of claim 17 further comprising a guard rail secured to said platform.

19. The system of claim 15, said elevator assembly comprising a car.

20. A stairway lift system operable between a lower floor and an upper floor of a building comprising:

a lift mechanism moveable between a first position and a second position;

an elevator assembly secured to said lift mechanism; and a stairway extending from said lower floor to said upper floor, said stairway including a fixed section and a movable section, said movable section being shiftable between a closed position and an open position in response to movement of said lift mechanism between said first and second positions, said fixed section remaining fixed during shifting of said movable section, said elevator assembly being located underneath said stairway when the movable section is in said closed position.

21. The system of claim 20, said elevator assembly being located proximate said lower floor when said lift mechanism is in said first position and proximate said upper floor when said lift mechanism is in said second position.

22. The system of claim 20, said elevator assembly comprising a platform having a guard rail secured thereto.

23. The system of claim 20, said elevator assembly comprising a car.

24. The system of claim 20, said system further comprising a controller coupled to said lift mechanism for controlling the movement of said lift mechanism between said first and second positions.

25. A stairway lift system operable between a lower floor and an upper floor comprising:

a lift mechanism moveable between a first position and a second position;

an elevator assembly secured to said lift mechanism; and a stairway section shiftable between a closed position and an open position in response to movement of said lift mechanism between said first and second positions, said elevator assembly being located underneath said stairway section when said stairway section is in said closed position, said shiftable stairway section comprising a plurality of individual stair steps, said stair steps being fixed relative to one another so that shifting of the stairway section does not require relative shifting of the individual stair steps.

26. A stairway lift system operable between a lower floor and an upper floor comprising:

a lift mechanism moveable between a first position and a second position;

an elevator assembly including a platform, said elevator assembly being secured to said lift mechanism; and a stairway section shiftable between a closed position and an open position in response to upward movement of said lift mechanism between said first and second positions, said platform being located underneath said stairway section when said stairway section is in said closed position.

* * * * *